United States Patent [19]

Satomura

[11] 4,389,968

[45] Jun. 28, 1983

[54] TONER REGENERATING DEVICE

[75] Inventor: Hiroshi Satomura, Hatogaya, Japan

[73] Assignee: Canon Kabushiki Kaisha, Tokyo, Japan

[21] Appl. No.: 265,164

[22] Filed: May 19, 1981

[30] Foreign Application Priority Data

May 26, 1980 [JP] Japan ..... 55-69841
Oct. 30, 1980 [JP] Japan ..... 55-152760

[51] Int. Cl.[3] ..... G03G 21/00

[52] U.S. Cl. ..... 118/652; 118/603; 15/256.51; 209/38

[58] Field of Search ..... 118/603, 608, 610, 652; 209/38, 227, 262; 15/256.51; 355/15

[56] References Cited

U.S. PATENT DOCUMENTS 1,693,033 11/1928 Hope ..... 209/227
3,654,901 4/1972 Donohue et al. ..... 118/652
3,950,092 4/1976 Zoltner ..... 118/652 X
4,000,062 12/1976 Keane ..... 209/38
4,054,381 10/1977 Bernhard ..... 355/15

*Primary Examiner*—John P. McIntosh
*Attorney, Agent, or Firm*—Fitzpatrick, Cella, Harper & Scinto

[57] ABSTRACT

A toner regenerating device is provided with a mesh disposed in the route of toner collected from an image bearing member, and apparatus for imparting to the collected toner through the mesh a force causing the collected toner to pass through the mesh and a force causing the collected toner to move along the mesh and in which the collected toner on the mesh containing foreign matter and solidified toner is loosened so that the solidified toner is divided into fine particles while, at the same time, the foreign matter is caused to float up over the collected toner and prevented from passing through the mesh.

13 Claims, 9 Drawing Figures

TONER REGENERATING DEVICE

BACKGROUND OF THE INVENTION

1. Field of the Invention

This invention relates to a device for making reusable developing toner used in an electrophotographic apparatus, an electrostatic recording apparatus or the like, and more particularly to a toner regenerating device for collecting toner remaining on an image bearing member after development or image transfer and making the collected toner reusable.

2. Description of the Prior Art

A construction in which solidified toner and foreign matters contained in toner removed and collected from an image bearing member by cleaning means are filtered through a mesh and only toner particles having passed through the mesh are again used for development has already been attempted. However, such construction has suffered from the disadvantage that the solidified toner and paper powder of copy paper or the like contained in the toner gradually clog the apertures of the mesh.

Further, paper powder fine enough not to clog the mesh passes through the apertures of the mesh and thereafter mixes with regenerated toner, thus bringing about an inconvenience during development. Of course, if a mesh having small apertures is used to cope with such inconvenience, fine paper powder may be filtered. In reality, however, there has been the disadvantage that solidified toner having a particle diameter larger than the aperture size of the mesh clogs the apertures of the mesh, thus greatly reducing the regenerating function.

SUMMARY OF THE INVENTION

It is an object of the present invention to provide a toner regenerating device for making collected toner reusable for development.

It is another object of the present invention to provide a toner regenerating device for well loosening and dividing the collected toner into fine particles.

It is still another object of the present invention to provide a toner regenerating device capable of effectively removing any small copy paper powder and other dust contained in the collected toner.

It is yet another object of the present invention to provide a toner regenerating device provided with a mesh best suited for toner regeneration and which is free of clogging and has an improved regenerating capacity.

The invention will become fully apparent from the following detailed description thereof taken in conjunction with the accompanying drawings.

DESCRIPTION OF THE PREFERRED EMBODIMENTS

Figure 1:
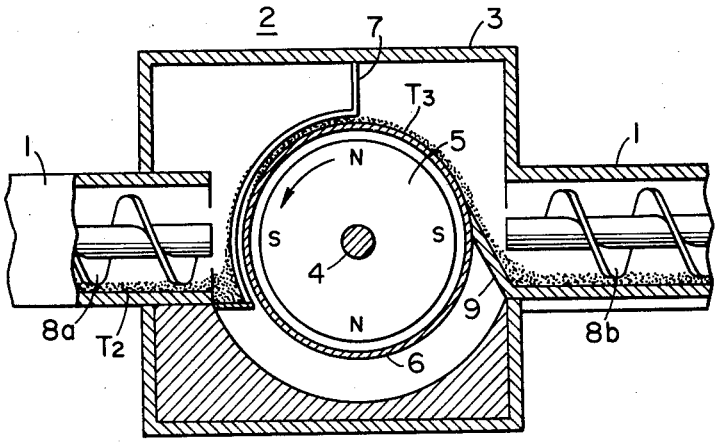
FIG. 1 is a side cross-sectional view of a first embodiment of the present invention.

FIG. 1 shows a first embodiment of the toner regenerating device 2 according to the present invention which is provided between collected toner conveying pipes 1 connecting the cleaning station and the developing station of a recording apparatus (not shown). The device 2 has a magnetic member 5 supported on a rotary shaft 4 and rotatable in counter-chockwise direction.

The magnetic member 5 has its outer peripheral surface magnetized to N and S poles at suitable intervals and is loosely inserted in a non-magnetic, hollow sleeve 6. The sleeve 6 has its opposite ends fixed to the wall 3 of the device and is immovably held and therefore, it is movable relative to the magnetic member 5. A non-magnetic mesh 7 for filtering collected toner is provided in proximity to the left upper portion of the outer periphery of the sleeve 6 so as to cover about a quarter of the outer periphery of the sleeve.

A screw conveyor 8*a* is provided within the pipe 1 for conveying collected toner $T_2$ to the device 2 for making toner reusable, whereby the magnetic collected toner $T_2$ arrives at the mesh 7 and is attracted onto the mesh 7 by the magnetic force and rotating operation of the magnetic rotatable member 5 and creeps up clockwisely along the mesh 7 while being loosened.

According to such loosening action, non-magnetic foreign maters such as paper powder which are not subjected to the magnetic attraction come to float up over the surface of the toner on the mesh 7. On the other hand, the magnetic collected toner $T_2$ is attracted to the mesh 7 by the magnetic attraction and is loosened, so that solidified toner is divided into fine particles which are attracted toward the sleeve 6 through the mesh 7. Regenerated toner $T_3$ on the sleeve 6 divided into fine particles and containing no foreign matter is further conveyed on the sleeve 6 and is scraped off by a scraper 9 bearing against the sleeve 6, whereafter the regenerated toner is again supplied to the developing station by a screw conveyor 8*b*. Foreign matter which has floated up over the surface of the collected toner on the mesh 7 and concentrated toner which could not be divided into fine particles gradually drop along the mesh and gradually build up on the riser portion of the mesh, and they may be collected at a suitable time.

Thus, according to the present embodiment, there is provided a toner regenerating device in which foreign matter is removed without clogging the mesh and collected toner is divided into fine particles and made reusable.

Figure 2:
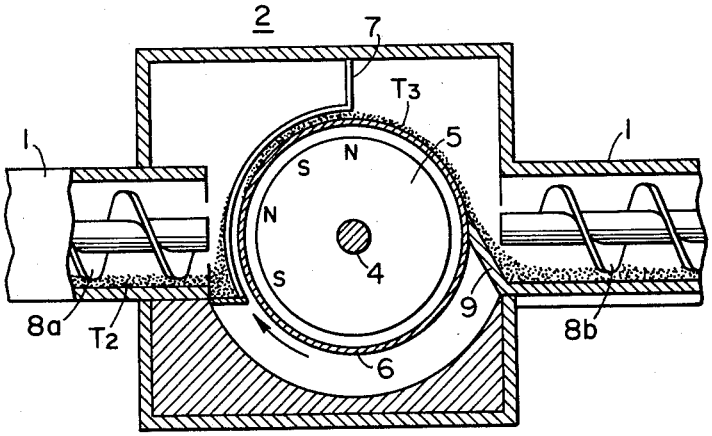
FIG. 2 is a side cross-sectional view of a second embodiment of the present invention.

FIG. 2 shows a second embodiment which, like the embodiment shown in FIG. 1, is suited for making magnetic toner reusable. In the present embodiment, the non-magnetic sleeve 6 is rotatable in clockwise direction while the magnetic member 5 disposed therewithin is immovable. N and S poles are formed only in the area of the outer peripheral surface of the magnetic member which is opposed to the proximate non-magnetic mesh 7. Therefore, fine toner particles of the collected toner conveyed to the mesh 7 by the screw conveyor 8*b* pass through the apertures of the mesh 7 to adhere to the sleeve before they are loosened, and are erected along the magnetic line of force. The erection reaches the mesh 7 and collected toner $T_2$ creeps up on the mesh 7 in the same direction as the toner which moves clockwisely on the sleeve 6 with the rotation of the sleeve 6.

Accordingly, the collected toner is loosened while creeping up on the mesh 7 and foreign matter is removed therefrom, and the toner now divided into fine particles is moved on the sleeve 6 toward the scraper 9. The toner on the sleeve 6 in the other area thereof than the area opposed to the mesh 7 is outside of the magnetic field and therefore, such toner is not subjected to the force attracting toner to the sleeve 6. Thus, the regenerated toner outside of said area is pushed toward the scraper 9 by the succeeding regenerated toner and slips down along the scraper 9 and into the pipe 1. In the present embodiment, the same effect as that of the first embodiment is of course achieved and moreover, toner is never deteriorated because it is not necessary to forcibly scrape off the toner by means of the scraper 9.

Figure 3A:
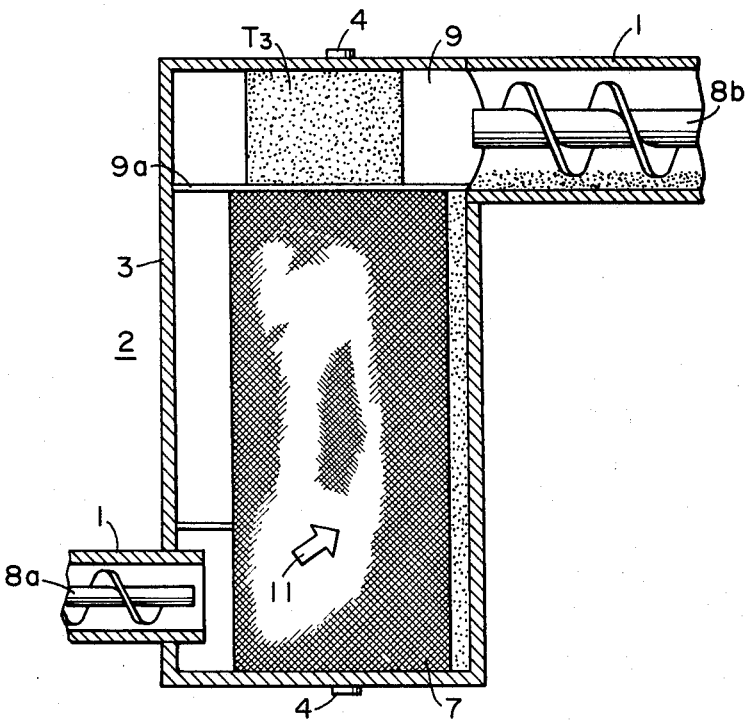
FIGS. 3A and 3B are a horizontal cross-sectional view and a side cross-sectional view, respectively, of a third embodiment of the present invention.
Figure 3B:
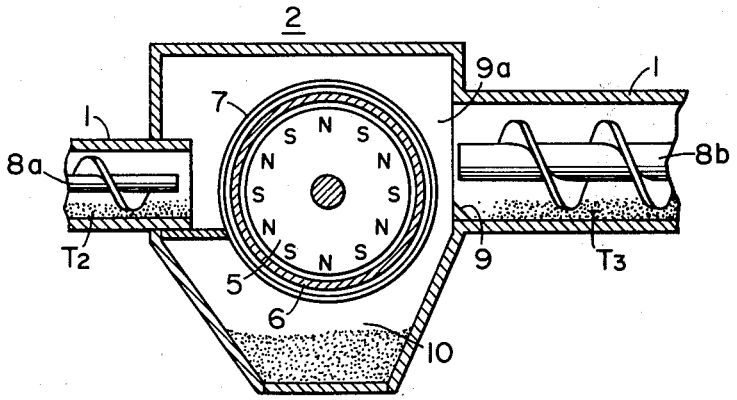

FIG. 3 shows a third embodiment of the present invention. Force imparting means of the rotatable magnetic member type is provided lengthwise of the wall member 3 of the toner regenerating device 2. A pipe 1 for supplying collected toner is secured to one end of the wall member 3 and the collected toner is supplied into the wall member 3 by a screw conveyor 8*a*. Accordingly, the collected toner arrives at a mesh 7 disposed so as to cover the outer peripheral surface of an immovable sleeve 6 having a counter-clockwisely rotatable magnetic member 5 therewithin.

Figure 4:
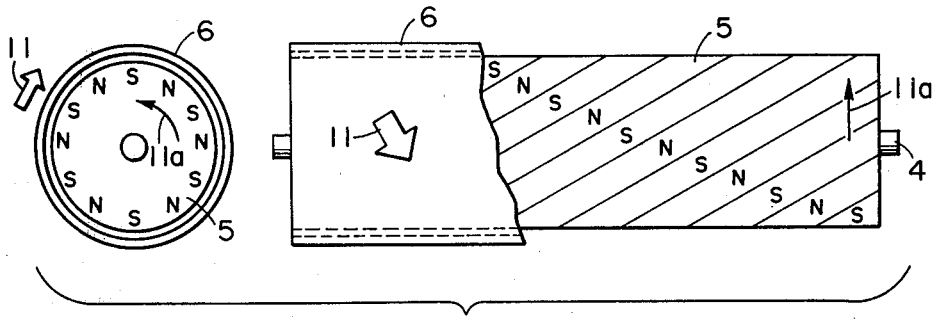
FIG. 4 illustrates the operation of a sleeve and a magnetic member used in the third embodiment.

FIG. 4 illustrates the operation of the force imparting means in the third embodiment. The surface of the rotatable magnetic member 5 is provided with alternately disposed belt-like N and S poles. Accordingly, if the magnetic member is rotated in counter-clockwise direction 11*a*, the magnetic toner on the non-magnetic sleeve 6 moves in axial direction 11 while rotating clockwisely.

Therefore, in FIG. 3, the collected toner moves on the mesh 7 in the direction of arrow 11 with foreign matter and solidified toner while being loosened. Accordingly, the toner can be loosened over a wide range of the mesh 7 and thus, the solidified toner can be sufficiently divided into fine particles and foreign matter can be caused to float up over the surface of the collected toner on the mesh 7. Thus, the foreign matter on the surface of the toner drops from gravity when it comes to the underside of the mesh 7, and can be accumulated in a groove 10 for storing foreign matter therein. On the other hand, the toner $T_3$ on the sleeve 6 sufficiently loosened and regenerated is scraped off by a non-magnetic scraper 9, is directed into the pipe 1 and is conveyed to the developing station by a screw conveyor 8*b*.

According to the third embodiment, a wide area of the mesh 7 can be used and the loosening action can be effected also lengthwise of the sleeve 6, so that solidified toner can of course be divided into finer particles and the removal effect of foreign matter is greater. Further, the device of the present embodiment is usable as either of the vertical type or the horizontal type.

Figure 5:
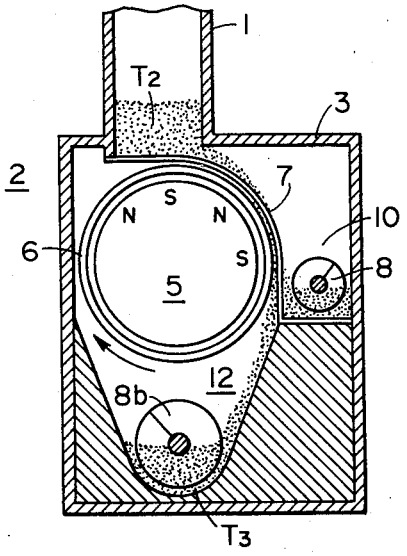
FIG. 5 is a side cross-sectional view of a fourth embodiment of the present invention.

FIG. 5 shows a fourth embodiment of the present invention. Collected toner $T_2$ is supplied from above to the toner regenerating device in a case 3 through a pipe 1. The collected toner $T_2$ drops onto a non-magnetic mesh 7 disposed in proximity to the lower open end of the pipe 1. The mesh 7 is formed substantially in an arcuate shape, and a non-magnetic sleeve 6 is provided for clockwise rotation in proximity to the back side of the mesh. A magnetic member is immovably disposed within the sleeve. The magnetic member is formed with N and S poles only in the portion thereof which is opposed to the sleeve 6.

Accordingly, the magnetic toner on the sleeve is loosened on the mesh and divided into fine particles and passes through the mesh, whereafter it is liberated from the magnetic force above a regenerated toner containing portion 12 and drops into and accumulate in the containing portion 12. The regenerated toner $T_3$ in the containing portion 12 is conveyed to the developing station by a screw conveyor 8*b*.

On the other hand, non-magnetic foreign matter is separated from the toner while being loosened on the mesh 7 and drops into a groove 10. Accordingly, at a suitable time, the foreign matter is discharged out of the case 3 with solidified toner which could not be divided into fine particles.

Now, in the conventional mesh method, clogging has occurred for 1,000 sheets of continuous copying, thus making regeneration of toner impossible. In contrast, in the toner regenerating devices shown in FIG. 1, regeneration of toner is possible even for 20,000 sheets of continuous copying. Further, even foreign matter much smaller than the spacing of the mesh can be removed.

An advantage of the present invention over the prior art device is that toner rolls on the mesh, whereby the foreign matter and solidified toner in the toner becomes loosened. The present invention also has a classifying effect provided by the mesh and this leads to the solution of the problem that regenerated toner becomes more non-uniform in a particle diameter than the initial toner and thus, the deterioration of image quality resulting from the regeneration of toner can be greatly alleviated and further, foreign matter (chiefly copy paper powder) which would cause irregularity on the developing sleeve can be sufficiently removed to eliminate irregularity.

Further, a particular excellence of the toner regenerating devices shown in FIG. 1 is that the conveyance force produced by magnetic energy has a selecting effect and does not act on foreign matter.

Further embodiments of the present invention will hereinafter be described in detail.

Figure 6:
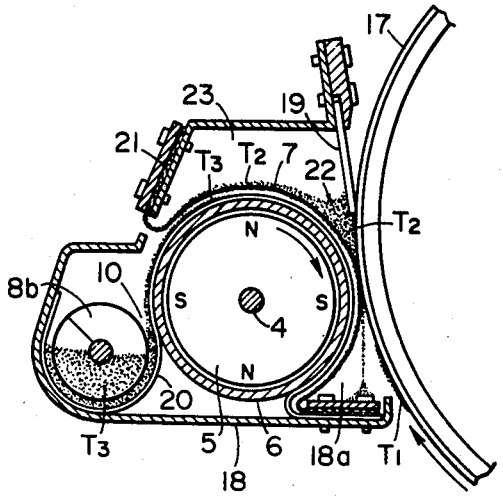
FIG. 6 is a side cross-sectional view of a fifth embodiment of the present invention.

FIG. 6 shows a fifth embodiment of the present invention. In this embodiment, the toner regenerating device is incorporated in the housing 18 of a cleaner for cleaning an image bearing drum 17 and collecting any residual toner $T_1$ therefrom.

Designated by 17 is a drum type image formation member (hereinafter simply referred to as the drum) such as a photosensitive medium in electrophotography or an insulating member in electrostatic recording. The drum 17 is rotatively driven in the direction of arrow. Disposed around the drum 17 are a latent image formation process instrument, a developing device and an image transfer device so that the process of latent image formation-development-image transfer for the drum surface is executed, although these instruments are not shown. In the present example, it is to be understood that development of latent image is effected by the use of one-component magnetic toner developer.

Figure 7:
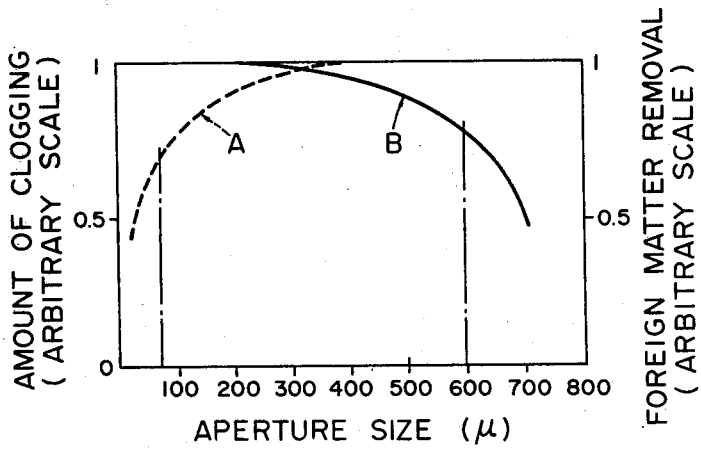
FIGS. 7 and 8 are graphs illustrating the toner regenerating capability of the present invention.

The cleaner for removing the residual toner $T_1$ remaining on the drum surface after having passed through the image transfer station and for cleaning the drum surface in preparation for the next image formation cycle utilizes a blade 19 whose edge bears against the surface of the rotating drum 17 to scrape off the residual toner $T_1$ from the drum surface. In the housing 18, a cylindrical magnetic member 20 is disposed substantially parallel to the axis of the drum 17. A magnetic member 5 has N and S poles formed on the surface thereof and is rotatively driven in clockwise direction. A non-magnetic sleeve 6 is concentrically fitted over the cylindrical magnetic member 5, is disposed for relative movement and is immovably fixed to the housing 18. Designated by 20 is a non-magnetic sheet (or film) such as synthetic resin, non-magnetic metal or paper brought into intimate contact with $\frac{3}{4}$ of the peripheral surface of the fixed sleeve excepting the lower $\frac{1}{4}$ of the peripheral surface. The right portion of the sheet 20 as viewed in FIG. 7 is fixed to the bottom surface of the housing 18 and the left portion of the sheet 20 extends along the bottom surface of the housing 18 and the inner surface of the left side wall of the housing to form a groove 10 of substantially semicircular cross-section for accumulating regenerated toner therein. Denoted by 7 is a mesh screen disposed along the arc of the sleeve 6 with which the sheet 20 is brought into intimate contact and in slightly spaced apart relationship with the surface of the sheet 20. The right portion of the mesh screen 7 extends to and is fixed to the bottom surface of the housing 18, and the left portion of the mesh screen 7 extends from a slit opening formed in the intermediate portion of the left side wall of the housing 18 to the outside of the housing, the left extrusion of the mesh screen being upwardly bent and fixed to the outer surface of the left side wall of the housing 18. In accordance with the present invention, the mesh screen 7 has mesh apertures five to fifty times as large as the particle diameter of the toner used.

Designated by **8*b* is a screw conveyor for discharging regenerated toner $T_3$ provided in the regenerated toner accumulating groove 10**.

In the above-described construction, the residual one-component magnetic toner $T_1$ on the surface of the drum 17 scraped off by the cleaning blade 19 drops into and accumulates in a wedge-shaped space 22 formed between the drum 17 and the mesh screen 7 along the sleeve 6. The collected toner $T_2$ is subjected to the magnetic force in the sleeve 6 through the sleeve 6, the sheet 20 and the mesh screen 7, and due to the gradient of the magnetic field based on the continuous rotation of the magnetic member 5 in the direction of arrow, the toner $T_2$ creeps up from the right side to the upper surface of the mesh screen 7 along the outer arcuate surface of the arcuate mesh screen 7 provided along the sleeve 6.

In this conveyance process of the collected toner $T_2$ along the surface of the arcuate mesh screen 7, the toner drops through the meshes of the screen 7 onto the surface of the sheet 20 around the outer periphery of the sleeve 6, and the toner $T_3$ which has thus dropped is attracted and held on the surface of the sheet 20 by the magnetic force of the magnetic member 5 and also is continuedly conveyed in the direction opposite to the direction of rotation of the magnetic member 5 along the surface of the sheet 20 due to the gradient of the magnetic field based on the rotation of the magnetic member 5, and enters the toner accumulating groove 10 and accumulates therein.

In the conveyance of the collected toner $T_2$ along the surface of the screen 7:

(a) The non-magnetic foreign matter such as the paper powder in the collected toner $T_2$ in the wedge-shaped space 22 and the dust in the air are not conveyed because they are not acted on by the conveyance force resulting from the magnetic field;

(b) Even if conveyed with the conveyed toner layer, foreign matter such as paper powder and dust is subjected to the moving force toward the surface of the mesh screen 7 with the toner layer $T_2$ and therefore, the mesh screen 7 substantially acts as one having small meshes, so that the foreign matter does not go through the meshes of the screen 7, but during the conveyance, due to the flowing movement of the layer $T_2$ and the mutual brushing of the conveyed toner layers $T_2$ and $T_3$ on the sheet 20 and the scrren 7, the foreign matter floats up from within the layer $T_2$ to the surface of the layer $T_2$ and separates from the layer $T_2$ and drops into the wedge-shaped space 22;

(c) Lumps of concentrated or solidified toner which are length enough to overcome the conveyance force resulting from the magnetic field are not conveyed;

(d) Even if conveyed with the conveyed toner layer $T_2$, concentrated or solidified toner is loosened and made into fine particles in the conveyance process by the loosening effect resulting from the flowing movement of the conveyed toner layer $T_2$, the frictional contact movement thereof with respect to the surface of the mesh screen 7 and the mutual brushing of the conveyed toner layers $T_2$ and $T_3$; part of the concentrated or solidified toner that could not be loosened does not go through the meshes of the screen 7 similarly to the paper powder and dust mentioned under item (b) above (because the conveyance is taking place in the direction along the surface of the screen 7 and the screen 7 substantially acts as one having small meshes), but floats up toward the surface of the layer $T_2$ and separates from the layer $T_2$ and drops into the wedge-shaped space 22; and (e) The paper powder and dust mentioned under item (a) which accumutate in the wedge-shaped space 22 and are not conveyed, the paper powder and dust mentioned under item (b) which have separated and dropped from the layer $T_2$, the large lumps of concentrated or solidified toner mentioned under item (c) which are not conveyed, and the toner mentioned under item (d) which has separated and dropped from the layer $T_2$ naturally drop from the gap at the bottom of the wedge-shaped space 22 and between the drum 17 and the mesh screen 7 into a housing space **18*a* below the wedge-shaped space 22** and are discharged therefrom.

Thus, only fine particles of toner drop through the meshes of the screen 7 onto the surface of the sheet provided along the outer periphery of the sleeve 6 and the toner $T_3$ which has thus dropped is conveyed along the surface of the sheet 20 into the groove 10 on the basis of the gradient of the magnetic field of the rotating magnetic member 5 and regenerated toner $T_3$ containing no foreign matter is collected in the groove 10. The regenerated toner $T_3$ is conveyed by a discharging screw conveyor 8 back into the developing device for reuse.

In this case, the meshes of the screen 7 are five to fifty times as large as the particle diameter of the toner and therefore, the passage of fine toner particles through the meshes of the screen takes place smoothly without clogging the meshes, thus greatly improving the quantitative handling capacity.

The limit of the size of the meshes of the mesh screen 7 has been emprically determined. That is, there is a great correlation among the particle diameter of the toner used, the size (aperture size) of the meshes of the mesh screen 7, the manner of clogging and the foreign matter removal effect. If the aperture size of the meshes of the mesh screen 7 is small in relation with the particle diameter of the toner used, the foreign matter removal effect will be improved, but clogging will occur or the amount of passage of the toner will be decreased to decrease the quantitative handling capacity. If the aperture size is increased, clogging will not occur and the amount of passage of the toner will be increased, but the foreign matter removal effect will be decreased. Therefore, according to the present invention, the aforementioned range of five to fifty times has been determined by quantitatively finding out, through various experiments, a range of aperture size of the meshes of the mesh screen 7 which practically satisfies both the quantitative handling capacity and the foreign matter removal effect in the relation with the particle diameter of the toner. By using the mesh screen 7 having a mesh aperture size in this range and by making the toner to be regenerated into a conveyed or flowing condition along the surface of such screen, it is possible to eliminate the clogging trouble and moreover, substantially sufficiently remove the foreign matters which would otherwise become a hindrance.

Description will now be made of some specific examples. In the device of FIG. 6, under the conditions that the particle diameter of the toner used is 12μ, the outside diameter of the sleeve 6 is 32 mm, the magnetic force of the magnetic member 5 is 640 gauss and the number of revolutions of the magnetic member 5 is 160 r.p.m., the amount of clogging and the amount of foreign matter removal have been examined with respect to mesh screen 7 having the following mesh aperture sizes in the relation to the toner particle diameter 12μ: 1 time=12μ, 2.5 times=30 μ, about 4.1 times≈50μ, 5 times=60μ, about 8.3 times≈100μ, about 16.6 times≈200μ, 25 times=300μ, about 33.3 times≈400μ, about 416 times≈500μ, 50 times=600μ, and about 58.3 times≈700μ. The result is shown in the graph of FIG. 7. As seen there, clogging is decreased as indicated by dotted curve A as the mesh aperture size of the mesh screen 7 becomes larger, while the amount of foreign matter removal is decreased as indicated by solid line curve B as the mesh aperture size becomes larger, and in practice, with the balance between the clogging and the foreign matter removal being taken into account, the mesh aperture size of the mesh screen 7 should preferably be in the range of 60 to 600μ, namely 5 to 50 times in the relation to the toner particle diameter 12μ, and any mesh aperture size smaller than 60μ results in increased clogging and greatly decreased quantitative handling capacity, while any mesh aperture size larger than 600μ results in passage of foreign matters through the meshes which means nullity of the toner regenerating effect.

Figure 8:
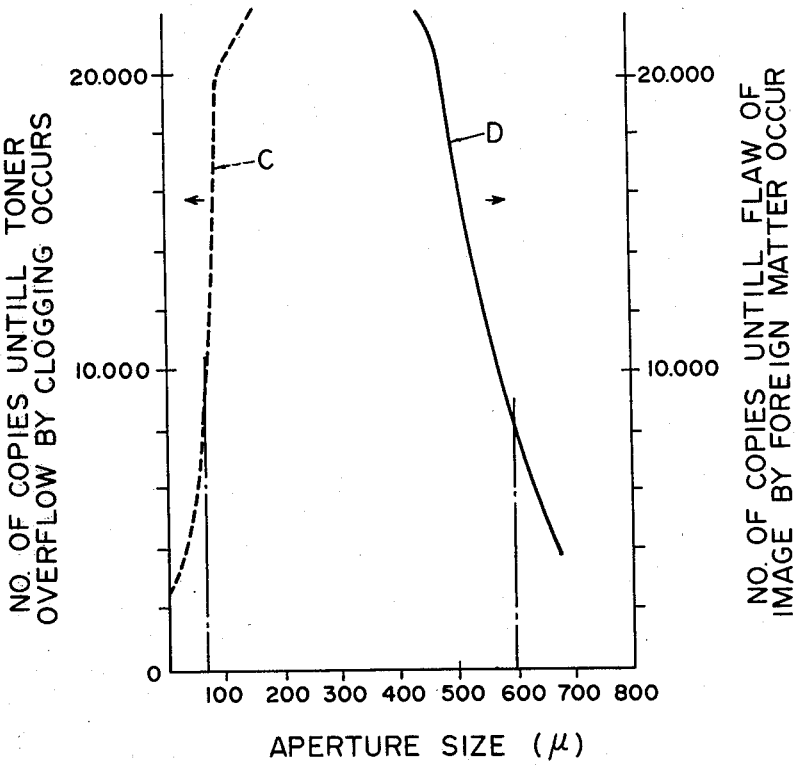

FIG. 8 shows the mesh aperture sizes of the mesh screen 7, the number of copies (dot-and-dash line curve C) at a point of time whereat toner fills (overflows) the collected toner containing space 23 of the FIG. 6 device when the image formation apparatus is operated for continuous copying, and the number of copies (solid line curve D) at a point of time whereat flaw of image by the foreign matters remaining unremoved in the regenerated toner occurs. As seen there, if the mesh aperture size of the mesh screen 7 is small, the collected toner containing space 23 becomes filled with toner at an early stage of the continuous copying due to the reduced quantitative handling capacity for toner regeneration which results from clogging. Also, if the mesh aperture size is large, flaw of image based on the unremoved foreign matters in the regenerated toner occurs at an early stage of the continuous copying due to the reduced foreign matter removal effect. If the aperture size of the mesh screen is within the mesh aperture size range according to the present invention, that is, if the mesh aperture size is set to the lower limit, namely, in the present example, 5 times or 60μ in the relation to the toner particle diameter 12μ, or the upper limit, namely, 50 times or 600μ, then continuous copying up to at least 8,000 sheets can be carried out without hindrance.

In contrast, according to the conventional mesh method, namely, the method which uses a mesh screen having a mesh aperture size substantially equal to the particle diameter of toner and in which regenerated toner is made to simply pass through the screen meshes for filtration, clogging will occur for about 1,000 sheets of continuous copying, and according to the rotating magnetic blade method, clogging will occur in the filtering gaps for about 300–5,000 sheets of continuous copying and this will make it necessary to clean the mesh screen and the filtering gaps frequently.

Also, the mesh screen may be made into a horizontal flat form and, along the upper surface thereof, regenerated toner may be rendered into a conveyed condition by magnetic or electrical means, whereby effective toner regeneration may be accomplished. That is, even if the mesh aperture size of the mesh screen is 5 to 50 times as large in the relation to the toner particle diameter as mentioned above, the foreign matters in the regenerated toner move along the surface of the screen and therefore, the mesh screen substantially acts as one having a small mesh aperture size so that the foreign matters do not pass through the meshes of the screen but float up over the upper surface of the conveyed regenerated toner layer due to the flowing movement resulting from the conveyance of the regenerated toner and are separated from the regenerated toner, and only fine particles of toner pass through the meshes of the screen. The foreign matters which have floated up over the upper surface of the regenerated toner layer and have been separated thereof may be removed from the screen surface as by a blow of lateral wind or such foreign matters may continuedly be conveyed on the screen surface and removed therefrom.

Alternatively, a flat mesh screen may be inclinedly disposed so that regenerated toner may flow down along the inclined surface of the screen and again in this case, foreign matters may be separated due to the above-described principle and only five particles of toner may pass downwardly through the screen surface to provide regenerated toner.

As a further alternative, the toner regenerating device need not be incorporated in a cleaner as in the example shown in FIG. 6, but may of course be constructed as an individual device.

In the device of FIG. 6, the sheet 20 covering the outer surface of the sleeve 6 is for smoothly directing the regenerated toner $T_3$ having passed through the mesh screen 7 to the discharge screw conveyor 8*b*, and instead of providing such sheet 20, it is also possible to design the device such that the regenerated toner having passed through the screen 7 is conveyed directly along the outer surface of the sleeve 6 and the regenerated toner on the sleeve surface is scraped off and collected from the sleeve surface by a blade in the groove 22.

Figure 9:
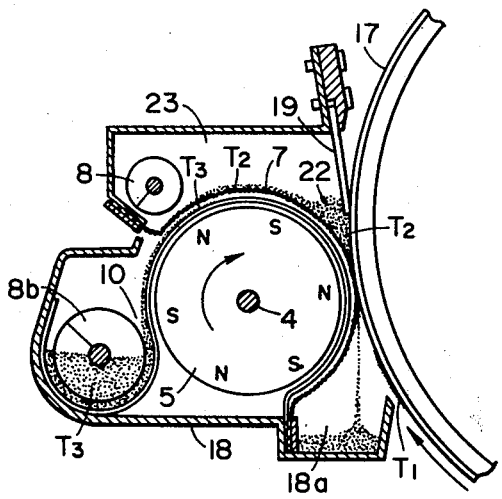
FIG. 9 is a side cross-sectional view of a seventh embodiment of the present invention.

FIG. 9 shows a modification of the fifth embodiment shown in FIG. 6. In this embodiment, a screw conveyor 8 as conveyor means for discharging toner which has not been divided into fine particles is provided in a collected toner containing space 23. Further, in the present embodiment, provision is made of a sleeve 6 and an insulative sheet-like member 20 serving also as the guide for regenerated toner. The sheet-like member 20 faces the screen 7 with a slight gap maintained between itself and a clockwisely rotatable magnetic member disposed inside of the sheet-like member and stretches into a containing portion 10. According to this embodiment, as compared with the device of FIG. 6, the conveyor means for loosening the collected toner is simple and it never happens that toner overflows from the toner containing space.

What I claim is:

1. A toner regenerating device comprising:

cleaning means for removing magnetic toner remaining on an image bearing body;

a mesh member;

means for guiding and supplying the toner removed by said cleaning means to said mesh member;

magnetic field imparting means provided adjacent to said mesh member at a location opposite to the side where toner is supplied by said guiding and supplying means;

non-magnetic toner carrying means provided between said magnetic field imparting means and said mesh member for bearing the toner which passes through said mesh member; and collecting means for collecting the toner born on said carrying means;

wherein said carrying means and magnetic field imparting means are relatively movable to carry onto and along said mesh member only a certain amount of the toner in accordance with the magnetic force imparted by said magnetic field imparting means from the total amount of the toner supplied by said cleaning means so that non-magnetic components are separated from the supplied toner and toner from which the non-magnetic components have been removed is born on said carrying means and collected.

2. A toner regenerating device according to claim 1, wherein said mesh member is of non-magnetic material.

3. A toner regenerating device according to claim 1, wherein said magnetic field imparting means is movable relative to said mesh member, and said mesh member and carrying means are fixed.

4. A toner regenerating device according to claim 2 or 3, wherein at least a part of said magnetic field imparting means is surrounded by said mesh member.

5. A toner regenerating device according to claim 1, wherein said magnetic field imparting means is a magnetic roller provided with magnetic poles along its periphery, and at least a part of said mesh member and said carrying means are concentric with said magnetic roller.

6. A toner regenerating device according to claim 5, wherein said magnetic roller is provided with alternating magnetic poles which are spirally arranged along its periphery.

7. A toner regenerating device according to claim 6, wherein the toner is supplied at one end of said magnetic roller and the toner is collected at the other end thereof.

8. A toner regenerating device comprising:

cleaning means for removing magnetic toner remaining on an image bearing body;

a mesh member;

means for guiding and supplying the toner removed by said cleaning means to said mesh member;

a magnetic roller provided adjacent to said mesh member at a location opposite to the side where toner is supplied by said guiding and supplying means;

non-magnetic toner carrying means provided between said magnetic roller and said mesh member to bear the toner which passes through said mesh member;

collecting means for collecting the toner born by said carrying means; and transport means for carrying the collected toner to a developing device;

wherein said carrying means and magnetic roller are relatively movable to carry onto and along said mesh member only a certain amount of the toner in accordance with the magnetic force of said magnetic roller from the total amount of the toner supplied by said cleaning means so that non-magnetic components are separated from the supplied toner and the toner from which the non-magnetic components have been removed is born on said carrying means, collected and transferred to the developing device.

9. A toner regenerating device according to claim 1 or 8, wherein the size of the apertures of said mesh member is five to fifty times as large as the diameter of the toner particles.

10. A toner regenerating device according to claim 9, wherein the size of the apertures of said mesh member is between about 60μ and 600μ.

11. A toner generating device according to claim 8, wherein said magnetic roller is stationary and said carrying means is concentric with magnetic roller and is rotatable.

12. A toner regenerating device according to claim 8, wherein said magnetic roller rotates and at least a part of said carrying means is concentric with said magnetic roller and is stationary.

13. A toner generating device according to claim 8, further comprising means to convey the recovered non-magnetic components.

* * * * *